US006782229B2

(12) United States Patent
Kurisu

(10) Patent No.: US 6,782,229 B2
(45) Date of Patent: Aug. 24, 2004

(54) FIXING DEVICE PROVIDED IN AN IMAGE FORMING APPARATUS AND HAVING A MECHANISM FOR POSITIONING A PEELING MEMBER RELATIVE TO A ROLLER

(75) Inventor: Toshiyuki Kurisu, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/390,643

(22) Filed: Mar. 19, 2003

(65) Prior Publication Data

US 2003/0185590 A1 Oct. 2, 2003

(30) Foreign Application Priority Data

Mar. 29, 2002 (JP) ..... 2002-097792

(51) Int. Cl.[7] ..... G03G 15/20
(52) U.S. Cl. ..... 399/323; 271/312
(58) Field of Search ..... 399/320, 322, 399/323; 271/311, 312, 313

(56) References Cited

U.S. PATENT DOCUMENTS 4,062,534 A * 12/1977 Sasahara ..... 271/311
6,587,662 B2 * 7/2003 Kobaru et al. ..... 399/323

FOREIGN PATENT DOCUMENTS

JP 7-175360 A 7/1995
JP 2000-44086 A 2/2000
JP 2002-040862 A 2/2002

* cited by examiner

*Primary Examiner*—Hoan Tran
(74) *Attorney, Agent, or Firm*—Foley & Lardner LLP

(57) ABSTRACT

A fixing device has a first roller, a second roller, a peeling member located on a sheet exit side relative to the paired rollers to be guided in a direction away from the first roller, and a positioning mechanism configured to position the peeling member. The positioning mechanism has a support shaft located on the sheet exit side relative to the first roller in a state parallel to the axis of the first roller, a positioning member carrying the peeling member, supported by the support shaft to rotate toward and away from a roller shaft, and configured to abut a peripheral surface of the roller shaft, and an elastic member configured to urge the positioning member in a direction to abut on the peripheral surface portion of the roller shaft.

8 Claims, 3 Drawing Sheets

FIXING DEVICE PROVIDED IN AN IMAGE FORMING APPARATUS AND HAVING A MECHANISM FOR POSITIONING A PEELING MEMBER RELATIVE TO A ROLLER

CROSS-REFERENCE TO RELATED APPLICATIONS

This application is based upon and claims the benefit of priority from the prior Japanese Patent Application No. 2002-097792, filed Mar. 29, 2002, the entire contents of which are incorporated herein by reference.

BACKGROUND OF THE INVENTION

1. Field of the Invention

The present invention relates to a fixing device provided in an image forming apparatus.

2. Description of the Related Art

One type of a device for fixing a toner image on a sheet under heating and pressing in an image forming apparatus that adopts electrophotography is known. This type is configured to fix a toner image on a sheet heated and pressed, while passing through a pair of rollers. Among fixing devices of this type is a fixing device that has an endless belt heated by a heating source. The endless belt runs on one roller and conveys a sheet, while rotating together with the other roller. The sheet is fixed a toner image while passing through between the belt and the other roller.

In a fixing device of heating/pressing type, a sheet with a toner image on it is passed through a pair of rollers facing the image-formed surface of the sheet, toward the heating roller, to fix a toner image on the sheet now efficiently heated. Therefore, the sheet may stick to the peripheral surface of the heating roller or to the surface of the belt running on this roller by causing the heated toner image may act as glue when the sheet is passed through a nip between the paired rollers. In this case, the sheet is no longer conveyed toward the downstream side in a conveying direction. Thus causes jamming of sheets in a fixing device.

This fixing device has a peeling member, which is provided at a sheet exit side of the pair of rollers. The peeling member guides the sheet coming from the nip between the paired rollers, in a direction away from the heating roller. Thus, the peeling member prevents the sheet from being left stuck on one of the paired rollers.

A gap must be provided between the forward end of the peeling member and the peripheral surface portion of the heating roller, so that the sheet passed through the paired rollers may be properly guided in a direction away from the heating roller. If the gap is too large, the sheet may enter into the gap, causing jamming of sheets. If the gap is too small, the forward end of the peeling member may contact the peripheral surface of the roller, inevitably damaging the peripheral surface portion of the roller.

Where, conventionally, the peeling member, if provided, is so positioned that the forward end of the peeling member provides a gap of necessary size, jointly with the peripheral surface portion of the roller. In this case, the peeling member is bolted to the body of the image forming apparatus. If the peeling member is secured to the body of the image forming apparatus, it is difficult to position the peeling member to create a gap that corresponds to a proper space between the forward end of the peeling member and the peripheral surface portion of the roller. After the peeling member is detached from the body, it is difficult to secure the peeling member again at the original position on the body to provide a proper gap between the forward end of the peeling member and the peripheral surface portion of the roller.

The peeling member is bolted to the body. It must be unbolted from the body to remove to eliminate sheet jamming. After the sheet jamming is eliminated, the peeling member must be bolted again at its mounting position of the body. It is cumbersome and troublesome to remove the peeling member from its mounting position and fix it at the original position.

Once jamming of sheets occurs between the peeling member and the roller in the fixing device, the peeling member must be detached from the body. After the sheet jamming is eliminated, the peeling member must be mounted at the original position. Thus, a cumbersome operation and a lot of time are required to remove the jammed sheets.

The present invention provides a fixing device, which can easily position the peeling member relative to the roller and also can easily set the peeling member at a predetermined position or remove it from this position.

BRIEF SUMMARY OF THE INVENTION

A fixing device according to an embodiment of the present invention has a first roller, a second roller configured to sandwich and convey the sheet together with the first roller to fix a toner image on a sheet, a peeling member located on a sheet exit side relative to the first and second rollers and configured to guide the sheet from a nip between the first roller and the second roller, away from the first roller, and a positioning mechanism configured to position the peeling member. The positioning mechanism has a support shaft which is located on a sheet exit side relative to the first roller in a state parallel to a central axis of the first roller, a positioning member which carries the peeling member, which is supported by the support shaft to be rotatable in a direction toward and away from the roller shaft of the first roller, and which is configured to abut the outer peripheral surface portion of the roller shaft, and an elastic member which is configured to urge the positioning member in a direction to abut on the peripheral surface portion of the roller shaft of the first roller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiment of the invention, and together with the general description given above and the detailed description of the embodiment given below, serve to explain the principles of the invention.

DETAILED DESCRIPTION OF THE INVENTION

Figure 1:
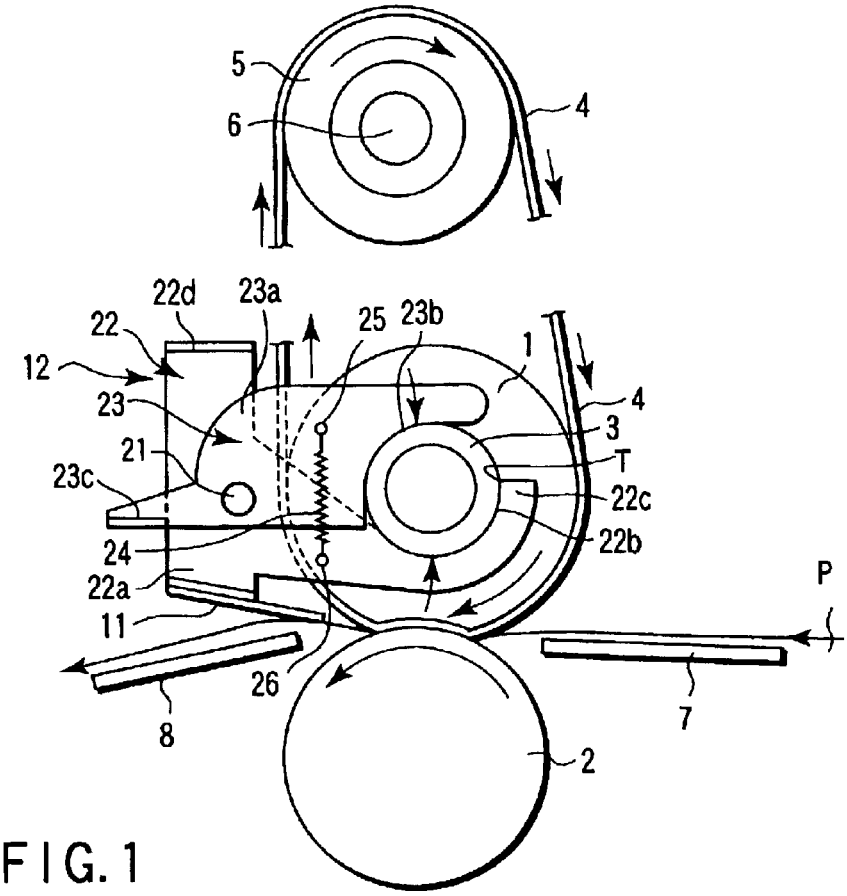
FIG. 1 is a side view showing a fixing device according to one embodiment of the present invention.
Figure 2:
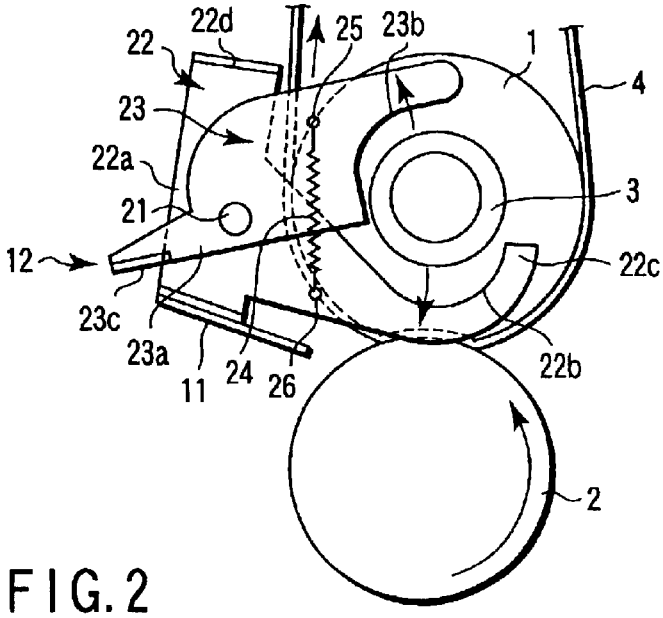
FIG. 2 is a side view illustrating a state, which is opened between the positioning member and auxiliary member, both incorporated in the fixing device of the present embodiment.
Figure 3:
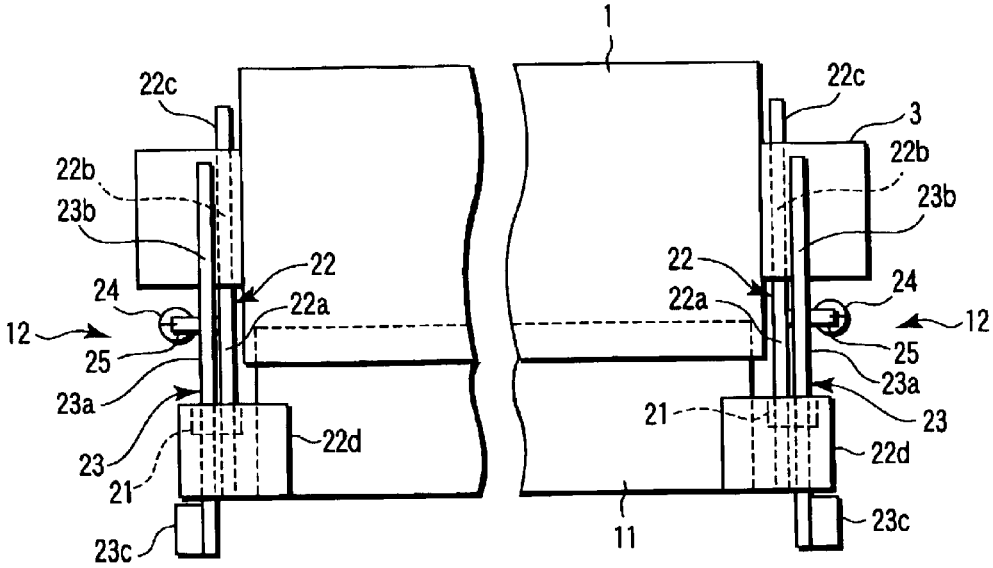
FIG. 3 is a plan view showing the first roller, peeling member and positioning mechanism, all provided in the fixing device of the present embodiment.

A fixing device according to one embodiment of the present invention will be explained, with reference to FIGS. 1 to 6. The fixing device has a first roller 1, a second roller 2, a belt 4, a heater roller 5, a heater 6, an entry-side sheet guide 7, an exit-side sheet guide 8, a peeling member 11 and a positioning mechanism 12. The first roller 1 and second roller 2 are paired rollers for fixing. This fixing device is of such a type that the belt 4 for heating is run on the first roller 1 which constitutes one of the paired rollers. The fixing device is provided within a body of an image forming apparatus, not shown.

The first roller 1 has a roller shaft 3 and is arranged in a horizontal position. The roller shaft 3 projects from both ends of the first roller 1. It is supported on bearings provided on the body of the image forming apparatus and can rotate. The second roller 2 is arranged parallel to the first roller 1, on the lower side of the first roller 1. The second roller 2 has both ends rotatably supported on bearings provided on the body of the image forming apparatus.

The belt 4 is of endless type. It is wrapped around an array of the first roller 1 and heater roller 5. The belt 4 contacts an upper side of the periphery of the second roller 2. The belt 4 is a little narrower than the first roller 1. The heater roller 5 is arranged above, and parallel to, the first roller 1. The heater 6 is provided within the heater roller 5 to heat not only the heater roller 5 but also the belt 4.

The heater roller 5 is rotated by a motor in a direction of the arrow shown in FIG. 1. The heater roller 5 rotates the belt 4 in directions of the arrows shown in FIG. 1. The first roller 1 is rotated through the circulation run of the belt 4. The belt 4 drives the second roller 2, which rotates in the direction of the arrow indicated in FIG. 1.

In FIG. 1, the right side is a sheet entry side and the left side a sheet exit side, with respect to an overlapped portion between the first roller 1 (and belt 4) and the second roller 2. A sheet P with a toner image formed thereon is conveyed from the sheet entry side, via the overlapped portion of the first roller 1 (and belt 4) and second roller 2, toward the sheet exit side in a direction indicated by the arrow in FIG. 1. While the sheet P is being so conveyed, the toner image keeps upward. When the sheet P passes through the overlapped portion, the toner image is heated and pressed onto the sheet P. The first roller 1 works as the heating-side roller. The entry-side sheet guide 7 is located on the sheet entry side, relative to the overlapped portion. The exit-side sheet guide 8 is provided on the sheet exit side.

The peeling member 11 guides the sheet, which has passed through the nip between the first roller 1 (and belt 4) and the second roller 2, away from the first roller 1 (and belt 4). The peeling member 11 is a strip that has substantially the same width as the first and second rollers 1 and 2. The peeling member 11 is parallel to the rollers 1 and 2 and arranged on the sheet exit side.

Two positioning mechanisms 12 are provided to position the peeling member 11 at a proper distance from the first roller 1 (and belt 4). One positioning mechanism 12 is provided at one end of the roller shaft 3 of the first roller 1. The other positioning mechanism 12 is provided at the other end of the roller shaft 3 of the first roller 1. In this embodiment, the respective positioning mechanism 12 has a support shaft 21, a positioning member 22, an auxiliary member 23 and an elastic member 24. The support shaft 21 is arranged on the sheet exit side, relative to the first roller 1 and parallel to the axis thereof. The shaft 21 is supported at the body of the image forming apparatus.

The positioning member 22 is made of a plate member and has a body section **22*a* and a shaft abutting section 22*b*. The positioning member 22 is arranged, extending in a direction perpendicular to the axis of the first roller 1. The body section 22*a* is located on the sheet exit side, relative to the first roller 1 (and belt 4) and second roller 2. The positioning member 22 is supported to rotate about the support shaft 21. One end portion of the peeling member 11 is attached to the lower portion of the body section 22*a* with bonding agent or by any other proper means such as screws. Therefore, the peeling member 11 can rotate, in a path describing an arc whose center is the support shaft 21, when the positioning member 22 is swung about the support shaft 21**.

The shaft abutting section **22*b* is shaped like an arc, curved upwardly. The shaft abutting section 22*b* is positioned at a lower side of the roller shaft 3 of the first roller 1 and can contact the roller shaft 3. That is, the shaft abutting section 22*b* is arranged next to the sheet sandwiching portion between the first roller 1 (and belt 4) and the second roller 2. The shaft abutting section 22*b* extends from the sheet exit side, beyond the sheet sandwiching portion, toward the sheet entry side. Thus, the shaft abutting section 22*b* contacts the peripheral surface of the roller shaft 3. The shaft abutting section 22*b* holds the peeling member 11 at a specific position with respect to the peripheral surface of the first roller 1 (and belt 4). The shaft abutting section 22*b* has a positional relationship, relative to the peeling member 11**, as will be set out below.

Figure 6:
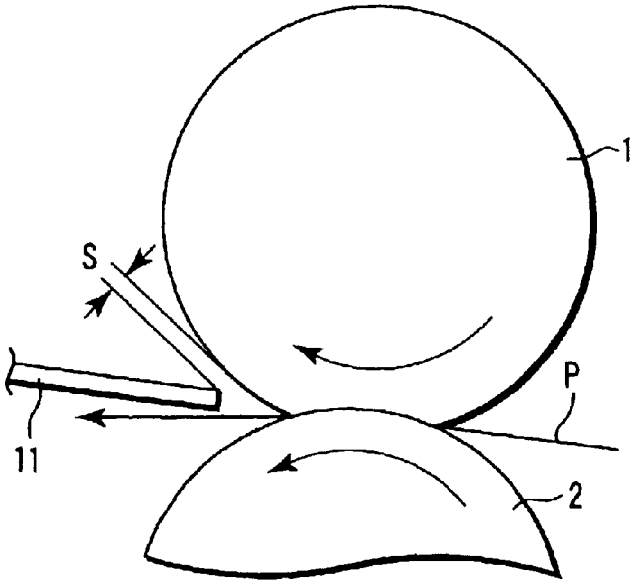
FIG. 6 illustrates a positional relationship between the peeling member and first and second rollers, in the fixing device of the present embodiment.

The shaft abutting section **22*b* is fitted over the outer peripheral surface of the roller shaft 3, as shown in FIG. 6. Therefore, a gap S is provided between the forward end portion of the peeling member 11 and the peripheral surface of the first roller 1 (and belt 4), having such a relationship as to create a proper distance, which allows the sheet P to be guided from the above-mentioned sheet sandwiching portion and in a direction away from the peripheral surface of the first roller 1**.

Figure 4:
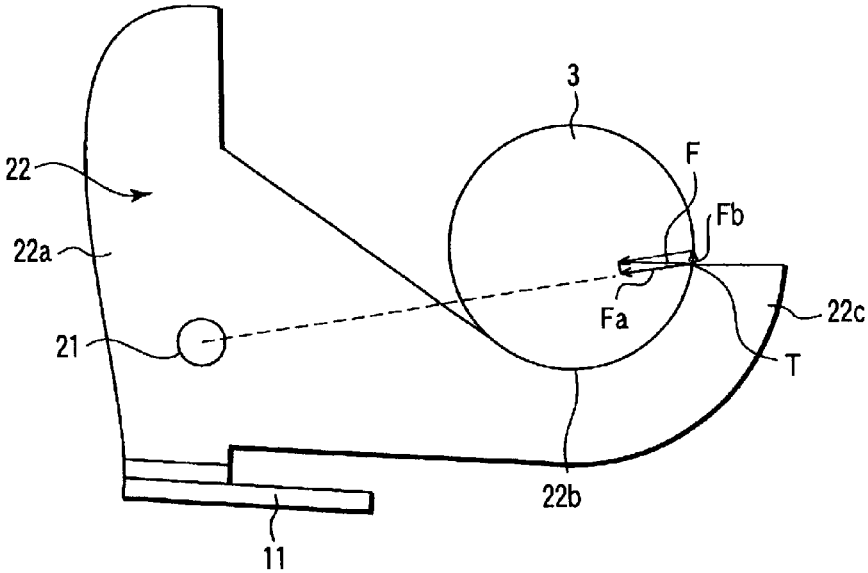
FIG. 4 represents a positional relationship that a contact point between the forward end of the positioning member and the roller shaft of the first roller has with the support shaft of the positioning member, in the fixing device of the present embodiment.
Figure 5:
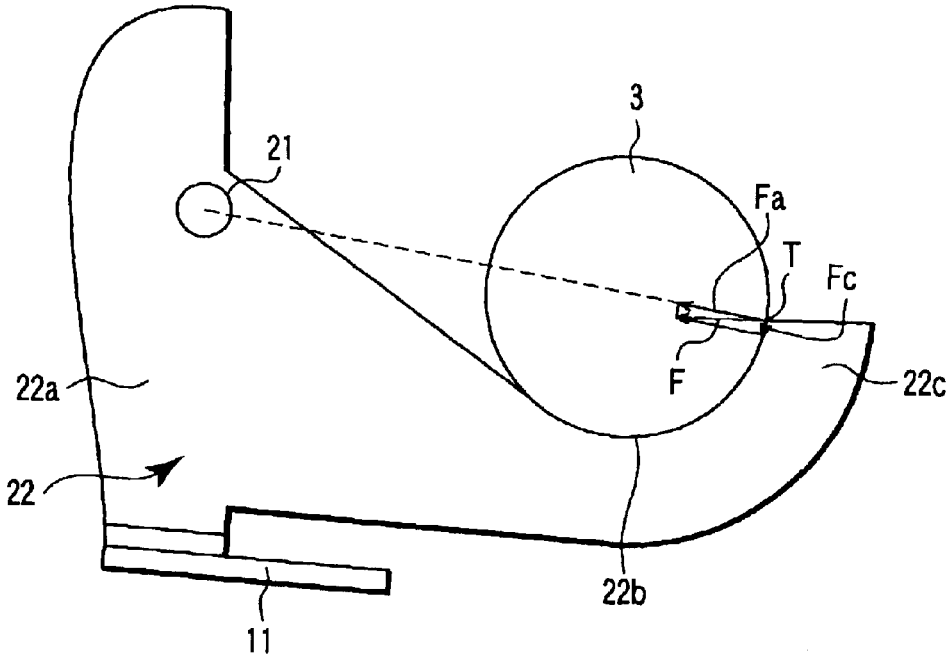
FIG. 5 depicts another positional relationship that the contact point has with the support shaft of the positioning member, in the fixing device of the present embodiment.

The forward end **22*c* of the shaft abutting section 22*b* abuts on the peripheral surface portion of the roller shaft 3 of the first roller 1. The support shaft 21 and forward end 22*c* of the shaft abutting section 22*b* abutting against the peripheral surface portion of the roller shaft 3 are so positioned to each other, generating a force Fb acting upstream in the rotational direction of the roller shaft 3. As FIG. 4 shows, the force Fb acts at a contact point T between the forward end 22*c* of the positioning member 22 and the peripheral surface portion of the roller shaft 3. In other words, the support shaft 21 and the forward end 22*c* of the shaft abutting section 22*b* have such a positional relationship that, at the contact point T, it is possible to avoid the generation of a force Fc that acts downstream in the rotational direction of the roller shaft 3 as shown in FIG. 5. In this embodiment, the forward end 22*c* (contact point T) of the shaft abutting section 22*b* abutting against the peripheral surface of the roller shaft 3 is set at the upper side, rather than the support shaft 21**.

The auxiliary member 23 is made of a plate member and has a body section 23*a* and a shaft abutting section 23*b*. The auxiliary member 23 is arranged, extending along a direction perpendicular to the central axis of the first roller 1. The body section 23*a* is located on the sheet exit side, relative to the overlapped portion between the first roller 1 (and belt 4) and the second roller 2. The auxiliary member 23 is supported to rotate about the support shaft 21. When rotated about the support shaft 21, both the positioning member 22 and the auxiliary member 23 are moved toward or away from each other, to a closed position or an open position.

The shaft abutting section 23*b* is arc-shaped, curved downwards. It is arranged on the upper side of the roller shaft 3, thus fitted over the roller shaft 3. That is, the shaft abutting section 22*b* is arranged next to the sheet sandwiching portion between the first roller (and belt 4) and the second roller 2, and extends from the sheet exit side beyond the sheet sandwiching portion, toward the sheet entry side. Thus, the shaft abutting section 23*b* may abut on the peripheral surface of the roller shaft 3.

An elastic member 24 applies a force to the positioning member 22 and auxiliary member 23, moving them toward each other, that is, to a closed position. In this embodiment the elastic member 24 is a tension spring. The elastic member 24 is arranged along an up/down direction, at the lateral sides of the positioning member 22 and auxiliary member 23. The elastic member 24 is supported by pins 25 and 26 projecting from the positioning member 22 and auxiliary member 23.

The positioning mechanism 12 thus structured is provided on the roller shaft 3, at both the ends of the first roller 1. It supports both ends of the peeling member 11.

In the positioning mechanism 12, the elastic member 24 applies a force in a direction toward the position where the positioning member 22 and auxiliary member 23 are closed. Therefore, the shaft abutting section 22*b* of the positioning member 22 and the shaft abutting section 23*b* of the auxiliary member 23 are fitted around the peripheral surface portion of the roller shaft 3 from the up/down sides, in a sandwiched relationship. Now that the shaft abutting section 22*b* of the positioning member 22 are fitted over the roller shaft 3, the peeling member 11 supported on the positioning member 22 is set to a position. This provides an appropriate gap S between the forward end of the peeling member 11 and the peripheral surface portion of the first roller 1 (and belt 4). A sheet P can be then guided from the nip between the first roller 1 (and belt 4) and the second roller 2 in a direction away from the peripheral surface portion of the first roller 1.

Therefore, the sheet P is guided from the nip between the first roller 1 (belt 4) and the second roller 2, while contacting the peeling member 11. The sheet P is conveyed toward the downstream side in the sheet conveying direction. Thus, it is possible to guide the sheet toward the downstream side smoothly. There is no risk of damaging the toner image or of jamming of sheet.

The peeling member 11 can be easily position to provide an appropriate gap o between the forward end of the peeling member 11 and the peripheral surface portion of the first roller 1, merely by rotating the positional member 22 and abutting it against the roller shaft 3.

The position member 22 receives a force acting in the sheet conveying direction when the sheet P is conveyed while contacting the peeling member 11. Therefore, the forward end 22*c* of the positioning member 22 applies a force F to the roller shaft 3, in the sheet conveying direction at the contact point T as shown in FIGS. 4 and 5. In this embodiment, the support shaft 21 and the forward end 22*c* are positioned to prevent the generation of a force Fc that acts downstream in the rotational direction of the roller shaft 3, at the contact point T between the forward end 22*c* and the peripheral surface of the roller shaft 3. Therefore, the force F is divided into a force Fa tending toward the support shaft 21 and a force Fb tending upstream in the rotational direction of the roller shaft 3, as shown in FIG. 4. In this case, the roller shaft 3 of a stationary member cancels the force Fa tending toward the support shaft 21, and the force Fb tending toward the upstream side (upper side) in the rotational direction of the roller shaft 3 acts to fit the positioning member 22 over the roller shaft 3. The force Fb keeps the positioning member 22 fitted to the roller shaft 3 and prevents the member 22 from moving from the roller shaft 3.

In the case shown in FIG. 5, the force F is divided into a force Fa tending toward the support shaft 21 and a force Fc tending toward the downstream side (lower side) in the rotational direction of the roller shaft. Hence, the positioning member 22 may be disengaged from the roller shaft 3.

Thus, the positioning member 22 and auxiliary member 23 can be rotated (swung) toward and away from each other about the support shaft 21 as a center. That is, when the positioning member 22 swings in this way, the peeling member 11 is rotated, together with the positioning member 22. The peeling member 11 can therefore be moved easily to a closing position near the peripheral surface portion of the first roller 1 and to a leaving position away from the peripheral surface portion of the first roller 1, that is, to a position far from the closing position.

The positioning member 22 and auxiliary member 23 are rotated, against a force of the elastic member 24, away from each other if jamming of paper sheets occurs for some reason, between the first and second rollers 1 and 2, on one hand, and the peeling member 11, on the other. As the members 22 and 23 are so rotated, the peeling member 11 set to the closing position is moved from the peripheral surface of the first roller 1. This renders it easy to take out the jammed sheets. A depressing piece 22*d* is provided to operate the positioning member 22, and a depressing piece 23*c* for operating the auxiliary member 23. When depressed, the depressing pieces 22*d* and 23*c* rotate the positioning member 22 and the auxiliary member 23 in a direction away from each other.

In this fixing device, the shaft abutting section 22*b* of the positioning member 22 extends, relative to the roller shaft 3, from the sheet exit side beyond the sheet sandwiching portion toward the sheet entry side. The shaft abutting section 22*b* fits over the periphery surface portion of the roller shaft 3. It can therefore more firmly grip the roller shaft 3 than in the case where it simply abuts the peripheral surface of the roller shaft 3. Further, the peeling member 11 can be easily moved toward and away from the roller shaft 3 in interlocking with the movement of the shaft abutting section 22*b*, when the shaft abutting section 22*b* is moved toward and away from the roller shaft 3.

The auxiliary member 23 is supported at the support shaft 21 and can rotate toward and away from the roller shaft 3 of the first roller 1. The auxiliary member 23 cooperates with the positioning member 22, sandwiching the peripheral surface of the roller shaft 3. Further, the elastic member 24 pulls the positioning member 22 and auxiliary member 23 in a direction the roller shaft 3 is sandwiched. Since the fixing device further has the auxiliary member 23, the positioning member 22 can contact and be reliably fitted over the roller shaft 3. That is, the auxiliary member 23 serves to assist the positioning member 22 abutting and fitting over the roller shaft 3 steadfast.

When the positioning member is rotated and brought into contact with the first roller, the peeling member is easily set at a position where a gap of a proper size is provided between the forward end of the peeling member and the peripheral surface of the roller. This keeps the peeling member away from the roller. Further, when the positioning member is rotated, the peeling member can be easily detached from the setting position and re-positioned. Thus, it is easy to remove jammed sheets involved.

Additional advantages and modifications will readily occur to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

What is claimed is:

1. A fixing device to fix a toner image on the sheet, comprising:

a first roller;

a second roller configured to sandwich and convey the sheet together with the first roller to fix the toner image on the sheet;

a peeling member located on a sheet exit side relative to the first and second rollers and configured to guide the sheet from a nip between the first roller and the second roller, away from the first roller; and a positioning mechanism configured to position the peeling member, the positioning mechanism having a support shaft which is located on a sheet exit side relative to the first roller in a state parallel to a central axis of the first roller, a positioning member which carries the peeling member, which is supported by the support shaft to be rotatable in a direction toward and away from a roller shaft of the first roller, and which is configured to abut a peripheral surface portion of the roller shaft, and an elastic member which is configured to apply a force to the positioning member in a direction to abut on the peripheral surface portion of the roller shaft.

2. A fixing device according to claim 1, wherein the positioning member is arranged next to a sheet sandwiching portion between the first roller and the second roller and extends from the sheet exit side beyond the sheet sandwiching portion toward a sheet entry side relative to the roller shaft of the first roller to abut and fit over the peripheral surface portion of the roller shaft.

3. A fixing device according to claim 2, wherein the support shaft and forward end of the positioning member abutting the peripheral surface of the roller shaft has a relation to prevent the generation of a force which acts downstream in a rotational direction of the roller shaft, at a contact point between the forward end of the positioning member and the peripheral surface portion of the roller shaft.

4. A fixing device according to claim 1, wherein the positioning mechanism further comprises an auxiliary member which sandwiches the peripheral surface portion of the roller shaft, together with the positioning member, and which is supported by the support shaft to rotate toward and away from the roller shaft.

5. A fixing device according to claim 4, wherein the elastic member applies a force to the positioning member and auxiliary member in a direction to sandwich the roller shaft.

6. A fixing device according to claim 4, wherein the auxiliary member has a depressing piece to be rotated about the support shaft in the direction away from the roller shaft.

7. A fixing device according to claim 1, further comprising a heater roller which is arranged parallel to the first roller, a belt which is run around an array of the first roller and heater roller, and a heater capable of heating not only the heater roller but also the belt.

8. A fixing device according to claim 1, wherein the positioning member has a depressing piece to be rotated about the support shaft in a direction away from the roller shaft.

* * * * *